US007406280B2

(12) United States Patent
Tomita et al.

(10) Patent No.: US 7,406,280 B2
(45) Date of Patent: Jul. 29, 2008

(54) MAGNET ROLLER DEVELOPING DEVICE AND IMAGE FORMING APPARATUS FOR REDUCING OBSTRUCTIONS IN DEVELOPER CIRCULATION PATH

(75) Inventors: Syohji Tomita, Yao (JP); Toshio Nishino, Yamatokoriyama (JP); Hiroshi Onda, Yamatokoriyama (JP); Takeshi Wakabayashi, Souraku-gun (JP); Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 112 days.

(21) Appl. No.: 10/571,006

(22) PCT Filed: Sep. 7, 2004

(86) PCT No.: PCT/JP2004/012992

§ 371 (c)(1),
(2), (4) Date: Mar. 8, 2006

(87) PCT Pub. No.: WO2005/024524

PCT Pub. Date: Mar. 17, 2005

(65) Prior Publication Data

US 2007/0025777 A1 Feb. 1, 2007

(30) Foreign Application Priority Data

Sep. 9, 2003 (JP) ..... 2003-317562
Feb. 16, 2004 (JP) ..... 2004-038375

(51) Int. Cl.
*G03G 15/08* (2006.01)

(52) U.S. Cl. ..... 399/274

(58) Field of Classification Search ..... 399/274, 399/284

See application file for complete search history.

(56) References Cited

U.S. PATENT DOCUMENTS 6,041,207 A 3/2000 Ishiguro et al.

FOREIGN PATENT DOCUMENTS

| | | |
|---|---|---|
| CN | 1209577 A | 3/1999 |
| JP | 62-169358 | 10/1987 |
| JP | 1-127577 | 9/1989 |
| JP | 1-1237577 | 9/1989 |
| JP | 3-089273 | 4/1991 |

(Continued)

OTHER PUBLICATIONS

Computer translation for JP2002-123085a□□□□Computer translation for JP2003005513a.*

(Continued)

*Primary Examiner*—Quana M Grainger
(74) *Attorney, Agent, or Firm*—Nixon & Vanderhye, P.C.

(57) ABSTRACT

A device including a developing roller having a magnet roller for transporting developer, and developing an electrostatic latent image, a regulating member regulating transportation amount of the developer transported to the electrostatic latent image with the development roller, and a reflux plate refluxing excess developer regulated by the regulating member away from the regulating member is constructed to comprise a rubbing member arranged to face the developing roller, at a second gap larger than a first gap defined by the developing roller and the regulating member, and rubbing developer transported to the first gap. The rubbing member carries out preliminary electrification on developer and then the regulating member carries out main electrification on the preliminarily electrified developer.

37 Claims, 13 Drawing Sheets

FOREIGN PATENT DOCUMENTS

| | | |
|---|---|---|
| JP | 10-198172 | 7/1998 |
| JP | 2002-006626 | 1/2002 |
| JP | 2002-123085 | 4/2002 |
| JP | 2003-005513 | 1/2003 |
| JP | 2003-215917 | 7/2003 |

OTHER PUBLICATIONS

International Search Report for PCT/JP2004/012992 dated Dec. 21, 2004.

* cited by examiner

| DISTANCE IN RADIAL DIRECTION | GAP | NORMALIZED MAGNETIC FLUX DENSITY | |
|---|---|---|---|
| R mm | G2 mm | B | B^2 |
| 25.0 | 0 | 1.00 | 1.00 |
| 26.0 | 1.0 | 0.68 | 0.46 |
| 27.7 | 2.7 | 0.45 | 0.20 |
| 28.2 | 3.2 | 0.41 | 0.17 |
| 29.0 | 4.0 | 0.36 | 0.13 |

| | | | |
|---|---|---|---|
| FLOW/REGULATED THICKNESS | g/(s·mm) | 0.34 | |
| MEASURED PASS AMOUNT M1 | g/(s·cm) | 0.172 | |
| GAP G1 | mm | 0.5 | 0.5 |
| GAP G2 | mm | 2.3 | 3.2 |
| MEASURED CIRCULATION AMOUNT M2-M1 | g/(s·cm) | 0.62 | 0.90-0.95 |
| CALCULATED PASS AMOUNT M2 | g/(s·cm) | 0.62 | 0.93 |

MAGNET ROLLER DEVELOPING DEVICE AND IMAGE FORMING APPARATUS FOR REDUCING OBSTRUCTIONS IN DEVELOPER CIRCULATION PATH

This application is the U.S. national phase of international application PCT/JP2004/012992 filed 7 Sep. 2004 which designated the U.S. and claims priority to JP 2003-317562 filed 9 Sep. 2003, and JP 2004-038375 filed 16 Feb. 2004, the entire contents of each of which are hereby incorporated by reference.

TECHNICAL FIELD

Example embodiments of the present invention relate to a developing device used for an image forming apparatus employing an electrophotographic system, such as a copier, printer, and facsimile machine, and the image forming apparatus.

BACKGROUND ART

FIG. 13 is a cross-sectional view showing a structure of a conventional developing device.

A developing device used for an image forming apparatus employing an electrophotographic system such as a copier includes a developing roller 101 for having a magnet roller 100 which transports two-element developer and developing electrostatic latent images held by a photosensitive drum, a regulating member 102 for regulating an amount of the developer transported to the electrostatic latent image with the developing roller 101, a reflux plate 103 for refluxing excess developer which is regulated by the regulating member 102 away from the regulating member 102, a hopper 104 in which the developer is contained, and a agitating roller 105 for agitating the developer in the hopper 104 (for example, see Japanese Patent Application Laid-Open No. 1-237577 (1989)).

The developing roller 101 includes the nonrotational magnet roller 100 in which magnetic poles N and magnetic poles S are alternatively arranged in the circumferential direction thereof and a nonmagnetic sleeve 106 which is rotatably fitted to the magnet roller 100.

The regulating member 102 is arranged near a developing range facing the developing roller 101, and the reflux plate 103 is provided at the opposite side of the regulating member 102 across the developing range.

According to the developing device having such structure, two-component carrier (magnetic power) and toner contained in the hopper 104 are agitated by the agitating roller 105 and toner is attached to circumference of the carrier. Further, as the sleeve 106 of the developing roller 101 rotates in opposite direction of the rotation of the photosensitive drum, developer between the developing roller 101 and the reflux plate 103 is transported toward a gap and the amount of the developer transported to the electrostatic latent image is regulated by the regulating member 102. The developer passed through the gap is transported to the electrostatic latent image. The excess developer regulated by the regulating member 102 accumulates in an interspace between the regulating member 102 and the reflux plate 103. As the accumulation amount increases, the developer flows toward upper surface of the reflux plate 103, is guided by the reflux plate 103, and refluxes toward the upper side of the agitating roller 105.

As developing devices in which two-component developer is employed, a developing device including a refluxing unit for refluxing excess developer which is regulated by a regulating member toward the upper side of an agitating roller and a reflux plate having a folded portion in one end of the refluxing unit is also well known (for example, see Japanese Patent Application Laid-Open No. 3-89273 (1991)).

However, there have been problems in the developing device disclosed in H No. 1-237577 (1989) having a structure in which the reflux plate 103 for refluxing excess developer away from the regulating member 102 is provided. The developer is transported to the gap without preliminary electrification in positive manner and the transportation amount of the developer is regulated by the regulating member 102. Accordingly, carrier of the developer transported to the gap is in state of chain composition with relatively strong force by the magnetic attraction force of the magnet roller 100. The part of the developer in chain composition state becomes excess developer by the regulation of the regulating member 102. As the excess developer increases, a ball of the developer in chain composition state may grow. The grown ball of developer drops into the downstream side of the reflux plate 103 because of the own weight, and thus, a developer circulation path toward the developer supply unit in the hopper 104 is not formed. Further, the number of turning on and off of the developer magnetic permeability sensor provided at the bottom of the hopper 104 increases so that the changes in electrification amount of the developer increases.

DISCLOSURE

Example embodiments have been made in view of the above problems and has an object of providing a developing device and an image forming apparatus capable of refluxing excess developer generated by a regulating member smoothly by providing a rubbing member for facing a developing roller at a second gap larger than a first gap between a developing roller and a regulating member and rubbing (rubbed friction) the developer with a regulation of layer thickness of developer transported to the first gap.

Another object of example embodiments is to provide a developing device and an image forming apparatus capable of maintaining a stable condition in which excess developer does not easily bind to each other by providing one of magnetic poles included in a magnet roller so that, at a position facing the second gap, a polar central axis thereof is toward the regulating member with respect to the position displaced 1.5 degrees away from the regulating member from a minimum position of the second gap.

Another object of example embodiments is to provide a developing device and an image forming apparatus capable of maintaining a stable condition in which excess developer does not easily bind to each other by providing one of magnetic poles included in a magnet roller so that, at a position facing the second gap, a polar central axis thereof corresponds to a mininmm position of the second gap.

Another object of example embodiments is to provide a developing device and an image forming apparatus capable of maintaining a stable condition in which excess developer does not easily bind to each other by providing one of magnetic poles included in a magnet roller so that, at a position facing the second gap, a polar central axis thereof is located toward the regulating member with respect to the minimum position of the second gap.

Another object of example embodiments is to provide a developing device and an image forming apparatus for an efficient preliminary electrification by defining a second gap G2 as a relation of first gap G1<second gap G2≦0.8×width of magnetic pole Dm.

Another object of example embodiments is to provide a developing device and an image forming apparatus capable of circulating developer smoothly by providing a developer accumulation preventing member for preventing accumulation of developer transported to the gap near a regulating member and/or rubbing member.

Another object of example embodiments is to provide a developing device and an image forming apparatus capable of reducing displacement of a rubbing member toward a gap expansion direction because of drag resulting from rubbing developer by forming a rubbing member with a reflux plate integrally.

Another object of example embodiments is to provide a developing device and an image forming apparatus capable of reducing curvature of a rubbing member toward a gap expansion direction because of drag resulting from rubbing developer by providing a convex portion, to a developer accumulation preventing member provided near a regulating member, which contacts with the reflux plate and prevents the bending of the rubbing member.

Another object of example embodiments is to provide a developing device and an image forming apparatus capable of reducing difference of degrees of deformation of a regulating member and a rubbing member caused by temperature changes by providing the regulating member and the rubbing member which have similar coefficient of linear expansion.

Another object of example embodiments is to provide a developing device and an image forming apparatus capable of maintaining an accurate positional relation among a developing roller, regulating member, and rubbing member by supporting the developing roller, regulating member, and rubbing member with a common supporting member.

Another object of example embodiments is to provide a developing device and an image forming apparatus capable of increasing circulation amount with preliminary electrification by defining developer amount M2 transported to a second gap to be M2>(M1/G1)G2, when developer amount transported from a first gap is defined as M1.

Another object of example embodiments is to provide a developing device and an image forming apparatus capable of reducing resistance of developer circulation at a third gap defined by a reflux plate and a developer accumulation preventing mdmber provided near a regulating member, and preventing reduction of developer circulation amount caused by circulation path resistance, by setting the third gap to be equal to or larger than 4.2 mm.

Another object of example embodiments is to provide a developing device and an image forming apparatus capable of reducing resistance of developer circulation at the third gap and preventing reduction of developer circulation amount caused by circulation path resistance, by providing a third gap -larger than a second gap.

Another object of example embodiments is to provide a developing device and an image forming apparatus capable of increasing proper toner concentration of the developer and improving the image quality, by providing a hopper containing developer magnetic powder having average particle size smaller than or equal to 65μm and toner having average particle size smaller than or equal to 7.5μm.

A developing device and an image forming apparatus according to example embodiments is a developing device and an image forming apparatus including a developing roller having a magnet roller for transporting developer, and developing an electro static latent image, a regulating member regulating transportation amount of the developer transported to the electrostatic latent image with the development roller, and a reflux plate refluxing excess developer regulated by the regulating member away from the regulating member, the device comprising: a rubbing member arranged to face the developing roller, at a second gap which is larger than a first gap defined by the developing roller and the regulating member, and rubbing developer transported to the first gap.

According to example embodiments, since the second gap is larger than the first gap, excess developer is certainly generated by the regulating member and circulation path of the excess developer can be formed. In addition, before developer is transported to the first gap, the rubbing member regulates layer thickness of the developer to rub, that is, provide rubbed friction, and preliminary electrification is performed on the developer. Accordingly, when the developer is two-component developer, repulsive force caused by the regulating member operates in the excess developer. The binding force in the developer can be reduced by the repulsive force and the developer is hardly bound to each other. As a result, the excess developer generated by the regulating member is smoothly refluxed toward the reflux plate, the developer is refluxed toward the start side of the circulation by the reflux plate, and the developer can be circulated smoothly.

A developing device and an image forming apparatus according to example embodiments is characterized in that the magnet roller has a plurality of magnetic poles arranged in circumferential direction thereof and one of the magnetic poles is provided so that, at a position facing the second gap, a polar central axis thereof is positioned toward the regulating member with respect to the position displaced 1.5 degrees from a minimum position of the second gap in the direction away from the regulating member.

According to example embodiments, since a polar central axis of the magnetic pole is positioned toward the regulating member from a minimum position of the second gap, the transportation amount of the developer transported to the second gap itself can be reduced and excess developer amount generated by the regulating member can be reduced. As a result, the excess developer can be maintained in a condition such that developer is hardly bound to each other.

A developing device and an image fonning apparatus according to example embodiments is characterized in that the magnet roller has a plurality of magnetic poles arranged in circumferential direction thereof and one of the magnetic poles is provided so that, at a position facing the second gap, a polar central axis thereof corresponds to a minimum position of the second gap.

According example embodiments, since a polar central axis of the magnetic pole corresponds to the minimum position of the second gap, the transportation amount of the developer transported to the second gap is kept from too much increase and excess developer generated by the regulating member can be maintained in a condition that developer is hardly bound to each other.

A developing device and an image forming apparatus according to example embodiments is characterized in that the magnet roller has a plurality of magnetic poles arranged in circumferential direction thereof and one of the magnetic poles is provided so that, at a position facing thc second gap, a polar central axis thereof corresponds to a minimum position of the second gap.

According to example embodiments, since a polar central axis of the magnetic pole corresponds to the minimum position of the second gap, the transportation amount of the developer transported to the second gap is kept from too much increase and excess developer generated by the regulating member can be maintained in a condition that developer is hardly bound to each other.

A developing device and an image forming apparatus according to an example embodiment is characterized in that the second gap G2 (mm) is defined as $$G1<G2\leqq 0.8\times Dm$$

where G1 is the first gap (mm) and Dm is width of magnetic pole (mm).

According to example embodiments, since the second gap is larger than the first gap, main electrification can be performed on the developer transported to the second gap by the regulating member after a preliminary electrification is performed by the rubbing member. Further, since it is defined as G2≦0.8×Dm, a state of high magnetic flux density near the reflux plate, that is, magnetic attraction force proportional to the square of the magnetic flux density is added to the carrier of the two-component developer. The layer thickness is regulated at the end of lower transportation stream at the rubbing member in a condition under relative large frictional force and preliminary electrification can be performed efficiently. Further, preferably, it is defined as G2 (⅔)×Dm to act as a condition that the magnetic flux density near the rubbing member is relatively high, that is, magnetic attraction force which is proportional to the square of the magnetic flux density on the carrier. The layer thickness is regulated at the end of lower transportation stream at the rubbing member in a condition under larger frictional force and preliminary electrification can be performed much more efficiently.

A developing device and an image forming apparatus according to the an example embodiment is characterized by further comprising a developer accumulation preventing member preventing accumulation of developer transported to the gap near the regulating member and/or the rubbing member.

According to example embodiment, since the developer accumulation preventing member is provided near the regulating member and/or the rubbing member, the magnetic flux density in the circulation path of the excess developer generated by the regulating member can be reduced and the developer is circulated smoothly. In addition, deterioration of the developer by unnecessary stress of developer accumulation can be prevented.

A developing device and an image forming apparatus according to an example embodiment is characterized in that the rubbing member is integrally formed with the reflux plate.

According to example embodiment, since the rubbing member and the reflux plate reinforce each other, bending of the rubbing member toward gap expanding direction caused by a drag of rubbing the developer can be reduced and the amount of the second gap is maintained. Further, bending of the reflux plate can be reduced, so that circulating ability of the developer is maintained.

A developing device and an image forming apparatus according to an example embodiment is characterized in that the developer accumulation preventing member provided near the regulating member has a convex portion which contacts with the reflux plate and prevents the displacement of the rubbing member by developer.

According to example embodiment since the convex portion of the developer accumulation preventing member contacts with the reflex plate to regulate bending of the rubbing member caused by developer, bending of the rubbing memember toward gap expanding direction caused by a drag of rubbing the developer can be reduced and the amount of the second gap is maintained. Further, bending of the reflux plate can be reduced, so that circulating ability of thc developer is maintained.

A developing device and an image forming apparatus according to example embodiment is characterized in that the regulating member and the rubbing member have similar coefficient of linear expansion.

According to example embodiment, since difference in deformation of the regulating member and the rubbing member by temperature changes can be reduced, deformation of the first gap and the second gap can be reduced. Accordingly, stable first gap and second gap can be obtained.

A developing device and an image forming apparatus according to an example embodiment is characterized in that the developing roller, the regulating member, and the rubbing member are supported by a common supporting member.

According to example embodiment, since the accurate positional relation among the developing roller, the regulating member, the rubbing member can be maintained, the amount of the first gap and second gap can be maintained. Further, the developing roller, the regulating member, the rubbing member can be integrated into a unit so that working property for assembly is improved.

A developing device and an image forming apparatus according to an example embodiment is characterized in that amount of developer transported to the second gap M2 (g/s/cm) is defined as $$M2>(M1/G1)G2$$

where G1 is the first gap (mm), G2 is the second gap (mm), and M1 is amount of developer transported from the first gap (g/s/cm.).

According to an example embodiment, since the developer transported into the second gap is not regulated in its layer thickness, the layer thickness is not even.

Accordingly, even when the average of transportation amount M2av is lower than or equal to the second gap G2·(M1/G1), a part of the developer contacts with the regulating member to be rubbed so that circulation amount by preliminary electrification can be increased.

A developing device and an image forming apparatus according to an example embodiment is characterized in that a third gap which is defined by the reflux plate and the developer accumulation preventing member provided near the regulating member is equal to or larger than 4.2 mm.

According to example embodiment, the circulation resistance of the developer at the third gap is reduced so that the reduction of the developer circulation amount caused by circulation path resistance can be controlled.

A developing device and an image forming apparatus according to an example embodiment is characterized in that the third gap is larger than the second gap.

A developing device and an image forming apparatus according to the an example embodiment is characterized by further comprising a hopper containing developer including magnetic powder in which average particle size is smaller than or equal to 65 μm and toner in which average particle size is smaller than or equal to 7.5 μm.

According to example embodiment, when the particle size of the developer is reduced to improve the image quality, it is particularly effective since proper toner concentration of the developer becomes high, magnetic attraction force is reduced, and more developer drops just below the regulating member.

As described above, according to an example embodiment, developer is rubbed by the rubbing member in advance to transport to the first gap and preliminary electrification is performed on the developer. Accordingly, when the developer is two-component developer, repulsive force can be given to the excess developer generated by the regulating member and the excess developer hardly binds to each other. As a result, circulation of the developer is performed smoothly.

Further, according to an example embodiment, one magnetic pole can be provided so that its polar central axis is located in the opposite side of the regulating member with respect to the minimum position of the second gap. Accordingly, the transportation amount of the developer transported to the second gap itself is reduced and excess developer amount generated by the regulating member can be reduced. As a result, the excess developer can be maintained in a condition that developer is hardly bound to each other.

According to example embodiment, one magnetic pole is provided so that its polar central axis corresponds to the minimum position of the second gap. Accordingly, the transportation amount of the developer transported to the second gap is kept from too much increase and excess developer generated by the regulating member can be maintained in a condition that developer is hardly bound to each other.

According to an example embodiment, one magnetic pole is provided so that its polar central axis is in the regulating side with respect to the minimum position of the second gap. Accordingly, the transportation amount of the developer transported to the second gap is kept from too much increase and excess developer generated by the regulating member can be maintained in a condition that developer is hardly bound to each other.

According to an example embodiment, since the width of the magnetic pole is set $G1<G2\leqq 0.8\times Dm$, a state of high magnetic flux density near the rubbing member is obtained so that preliminary electrification is performed efficiently.

According to an example embodiment, since the developer accumulation preventing member for preventing accumulation of developer transported to the gap is provided, the magnetic flux density in the circulation path of the excess developer generated by the regulating member can be reduced and the developer is circulated smoothly. In addition, deterioration of the developer by unnecessary stress of developer accumulation can be prevented.

According to example embodiment, since the rubbing member and the reflux plate reinforce each other, bending of the rubbing member toward gap expanding direction caused by a drag of rubbing the developer can be reduced and the amount of the second gap is maintained. Further, bending of the reflux plate can be reduced, so that circulating ability of the developer is maintained.

According to an example embodiment, since the convex portion of the developer accumulation preventing member contacts with the reflex plate to prevent bending of the rubbing member caused by developer, bending of the rubbing member toward gap expanding direction by a drag of rubbing the developer can be reduced and the amount of the second gap is maintained. Further, bending of the reflux plate can be reduced, so that circulating ability of the developer is maintained.

According an example embodiment, since difference in deformation of the regulating member and the rubbing member caused by temperature changes can be reduced, deformation of the first gap and the second gap can be reduced. Accordingly, stable first gap and second gap can be obtained.

According to an example embodiment, since the accurate positional relation among the developing roller, the regulating member, the rubbing member can be maintained, the amount of the first gap and second gap can be maintained. Further, the developing roller, the regulating member, the rubbing member can be integrated into a unit so that proper working of the assembly is improved.

According to an example embodiment even when the average of transportation amount M2av is lower than or equal to the second gap $G2\cdot(M1/G1)$, a part of the developer contacts with the regulating member to be rubbed so that circulation amount by preliminary electrification can be increased. According to an example embodiment, since the third gap G3 is equal to or larger than 4.2 mm, the circulation resistance of the developer at the third gap is reduced and the reduction of the developer circulation amount caused by circulation path resistance can be controlled.

According to an example embodiment, since the third gap is larger than the second gap, the circulation resistance of the developer at the third gap is reduced and the reduction of the developer circulation amount caused by circulation path resistance can be controlled.

According to an example embodiment, when the particle size of the developer is reduced to improve the image quality, it is particularly effective since proper toner concentration of the developer becomes high, magnetic attraction force is reduced, and more developer drops just below the regulating member.

BRIEF DESCRIPTION OF THE DRAWINGS

FIG. 7(*b*) is a view showing normalized magnetic flux density of component in the radial direction corresponding to displacement angle from the minimum position (a) of the polar central axis;

FIG. 8(*b*) is a view showing normalized magnetic flux density of component in the rotational direction corresponding to displacement angle from the minimum position (a) of the polar central axis;

BEST MODE

An example embodiment of the present invention will be described with reference to the drawings.

Figure 1:
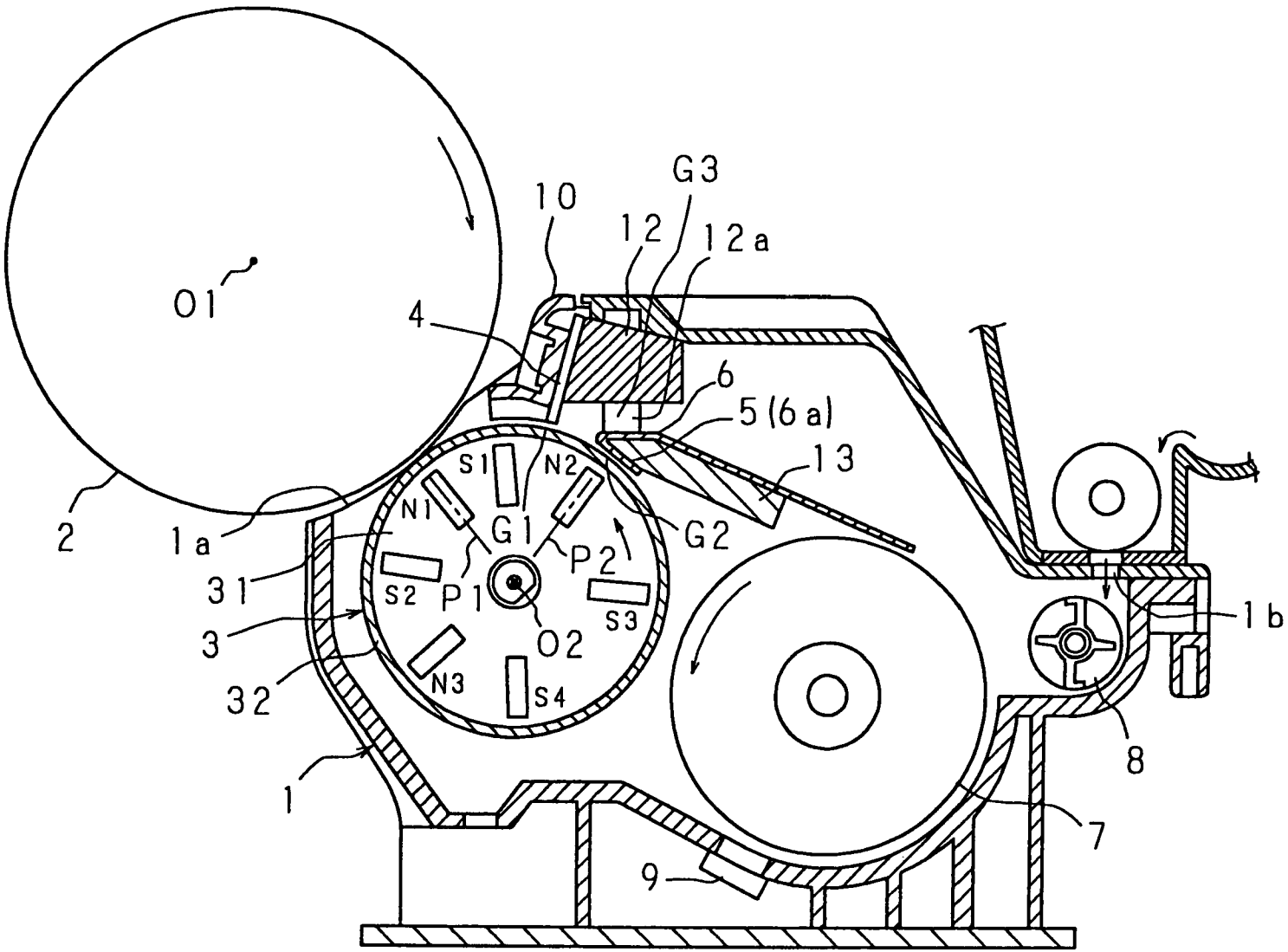
FIG. 1 is a cross-sectional view showing a structure of a developing device according to an example embodiment.

FIG. 1 is a cross-sectional view showing a structure of a developing device according to an example embodiment.

The developing device includes a hopper 1 for containing two-component developer, a developing roller 3 for transporting the developer to an electrostatic latent image held by a photosensitive drum 2 and developing the electrostatic latent image, a regulating member 4 for regulating the amount of the developer transported to the electrostatic latent image with the developing roller 3, a rubbing member 5 for facing the developing roller 3 at a second gap G2 which is larger than a first gap G1 defined by the developing roller 3 and the regulating member 4, regulating layer thickness of the developer transported to the first gap G1 to rub the developer, a reflux plate 6 for refluxing excess developer regulated by the regulating member 4 away from the regulating member 4, and an agitating roller 7 for agitating the developer in the hopper 1. Here, the regulating member 4, rubbing member 5, and the refluxing plate 6 are formed in a length corresponding to the length of the developing roller 3.

The hopper 1 is formed in almost prismatic shape including an opening la in a position facing a circumference of the photosensitive drum 2 and a developer supply unit 1*b* in a position away from the opening 1*a*. The developing roller 3 and the regulating member 4 are provided in a position facing the opening la of the hopper 1 and the agitating roller 7 is rotatably provided in a position facing the developer supply unit 1*b*. Further, a transporting roller 8 is rotatably provided between the developer supply unit 1*b* and the agitating roller 7, for transporting developer (toner) supplied into the hopper 1 through the developer supply unit 1*b* to the agitating roller 7. A magnetic permeability sensor 9 for detecting toner density in the hopper 1 is provided on the downside of the agitating roller 7. Accordingly, in case that toner amount agitated by the agitating roller 7 becomes lower than the proper amount, toner may be supplied through the developer supply unit 1*b* in accordance with the detected value.

The developing roller 3 includes a magnet roller 31 as a multi-pole magnetization in which magnetic poles NI, N2, N3 and magnetic poles S1, 82, 83 made of bar magnets having rectangle cross sectional shapes are arranged separately from each other and radially in the circumferential direction, and a nonmagnetic sleeve 32 which is rotatably fitted to the magnet roller 31. The magnet roller 31 has its both ends nonrotatably supported by the walls of the hopper 1. The magnetic pole Ni is arranged in a position facing the circumference of the photosensitive drum 2 and the magnetic pole N2 is arranged in a fashion facing the second gap G2. The magnetic poles N1 and N2 have polar central axes P1 and P2 in centers in their widths in the circumferential direction of the developing roller 3 throughout their entire length.

The magnetic pole N1 facing the photosensitive drum 2 is arranged so that the polar central axis P1 is displaced 3 degrees toward upper stream of developer transportation with respect to a line which runs through a central axis O1 of the photosensitive drum 2 and a central axis O2 of the developing roller 3. The bias amount of the polar central axis P1 of the magnetic pole N1 is measured by a measure. This measure has a magnetic guide which rotates about the central axis O1 of the photosensitive drum 2 and the bias amount is detected in accordance with the rotational angle of the guide.

Figure 2:
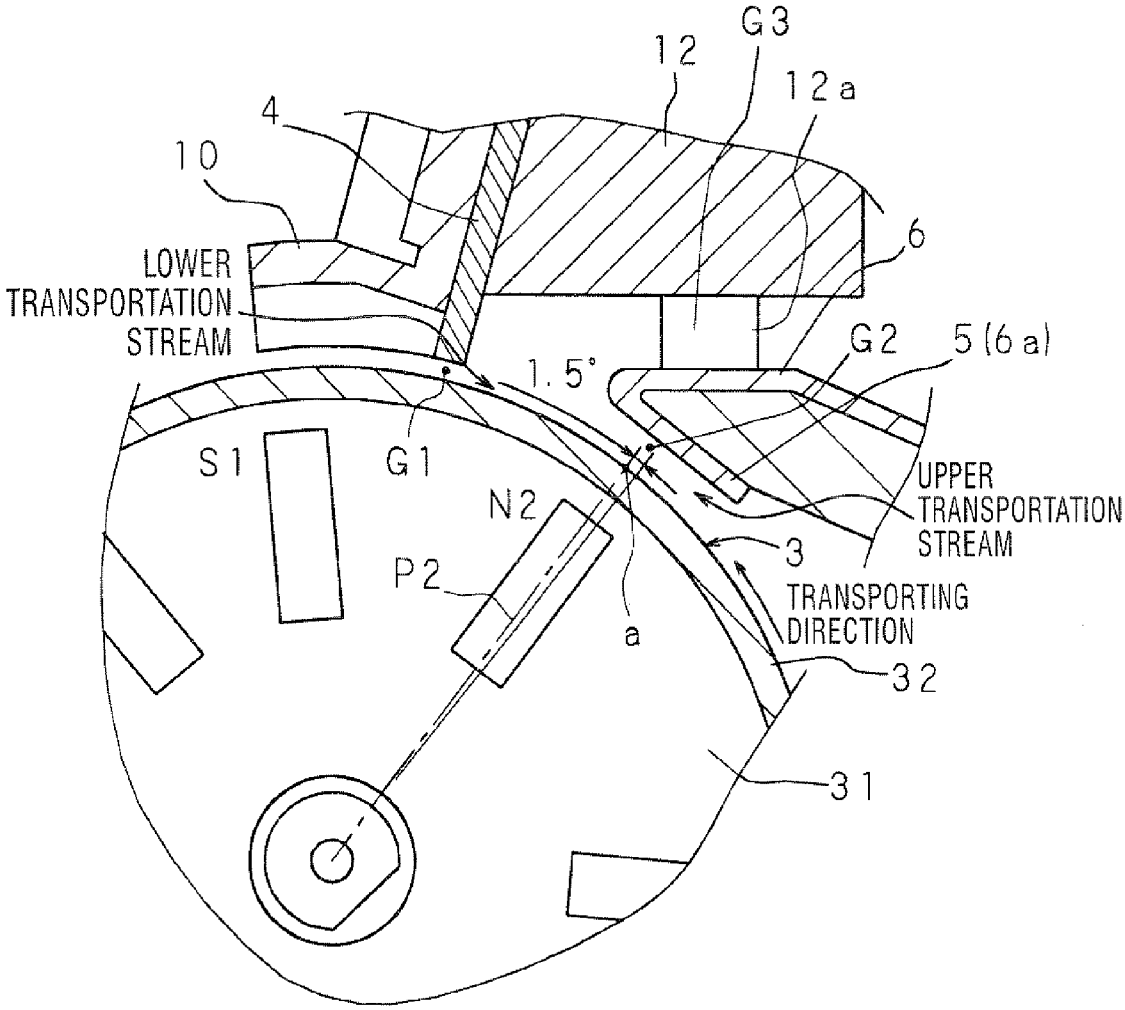
FIG. 2 is a magnified view of a main part of the developing device according to an example embodiment.

FIG. 2 is a magnified view of a main pan. The magnetic pole N2 facing the second gap G2 is positioned so that the polar central axis P2 is positioned toward the regulating member 4 with respect to the minimum position (a) of the second gap G2, in other words, positioned closer to the regulating member 4 (downstream of developer transportation) with respect to the position displaced 1.5 degrees toward the upper stream of developer transportation. Further, the width size Dm of the magnetic pole N2 in the circumferential direction of the developing roller 3 is set to 4 mm.

The regulating member 4 carries out main electrification of the developer as regulating the amount of developer transportation with the developing roller 3. The regulating member 4 is made of a nonmagnetic metal plate having a rectangle cross sectional shape and one surface of the regulating member 4 in its width direction faces the circumference of the developing roller 3 at the first gap G1. The coefficient of linear expansion of the regulating member 4 is almost the same as that of the rubbing member 5. In other words, the regulating member 4 and the rubbing member 5 are made of similar material and even when the regulating member 4 and the rubbing member 5 are displaced with curvature result from temperature changes at both ends in longitudinal direction, the changes in the first gap G1 and the second gap G2 can be reduced. Further, the regulating member 4 is located inside of the opening 1*a* of the hopper 1 and between the magnetic pole S1 and the magnetic pole N2. The regulating member 4 is fixed to the opening 1*a* through a cover body 10 which is fixed to the regulating member 4. Here, the regulating member 4 and the rubbing member 5 are made of metal plates such as aluminum or stainless steel.

The rubbing member 5 carries out preliminary electrification of the developer as regulating the transportation amount (layer thickness) of developer transported to the first gap G1 with the developing roller 3 and rubbing the developer. The rubbing member 5 is integrally formed with the nonmagnetic reflux plate 6. The reflux plate 6 is arranged so as to be a slope from the upper portion of the developing roller 3 toward the upper portion of the agitating roller 7 in a manner that the developing roller 3 is higher than the agitating roller 7. The end in the developing roller 3 side of the reflux plate 6 is folded toward the developing roller 3 so as to form a folded section 6*a*. The folded section 6*a* is defined as the rubbing member 5.

The rubbing member 5 is formed flat and the developing roller 3 is formed in a round shape so that the minimum position (a) is defined in the second gap G2.

The relationship between the second gap G2, the first gap G1 (mm), and the width Dm of the magnetic pole N2 (mm) is set as below.

$$G1<G2\leqq 0.8\times Dm$$

It is preferable that the first gap G1 is typically set as 0.5 mm and the second gap G2 is typically set as 2.3 mm or 3.2 mm. The width Dm of the magnetic pole N2 is set as 4 mm as mentioned above, however, this width is not limited if it is a proper width.

The relationship among the first gap G1, the second gap G2, developer amount M1 (g/s/cm) per unit length transported from the first gap G1, and developer amount M2 (g/s/cm) per unit length transported from the second gap G2 is set as below.

$$M2>(M1/G1)G2$$

Here, the M1 and M2 are amounts of developer transported through the gaps for 10 seconds and the measured length between the regulating member and the rubbing member in the longitudinal direction is 5 cm. (M1/G1) is a weight (g) of the developer transported through the gap per unit length of the gap.

A first developer accumulation preventing member 12 for preventing developer transported to the first gap G1, that is, excess developer regulated by the regulating member 4, from accumulating in upper stream of the regulating member 4 is provided adjacent to the regulating member 4 in the hopper 1. Further, a second developer accumulation preventing member 13 for preventing developer transported to the second gap G2 from accumulating in upper stream of the rubbing member 5 is fixed adjacent to the rubbing member 5.

The first developer accumulation preventing member 12 and the second developer accumulation preventing member 13 are made of nonmagnetic materials such as metal or synthetic resin having a length corresponding to the developing roller 3. The first developer accumulation preventing member 12 is arranged between an end of the regulating member 4 in the width direction and an upper wall of the hopper 1 and the developer accumulation preventing member 12 is separated from the reflux plate 6 in the vertical direction so as to lead the excess developer to the reflux plate 6 smoothly. In addition, a plurality of convex portions 12*a* are provided separately from each other in a longitudinal direction at the bottom part of the developer accumulation preventing member 12 so as to contact with the upper surface of the reflux plate 6. The convex portion 12*a* prevents the reflux plate 6 from bending upwardly. Here, in FIG. 1, the developer accumulation preventing member 12 is laid from the regulating member 4 to an end of the reflux plate 6, however, the length of the developer accumulation preventing member 12 from the regulating member 4 is not limited. Further, the developer accumulation preventing member 12 may be integrally formed with the regulating member 4.

The second developer accumulation preventing member 13 is provided between the rubbing member 5 and the reflux plate 6 along the lower surface of the reflux plate 6, so that the developer may be smoothly transferred to the second gap G2. The second developer accumulation preventing member 13 may be integrated into the reflux plate 6.

Figure 3:
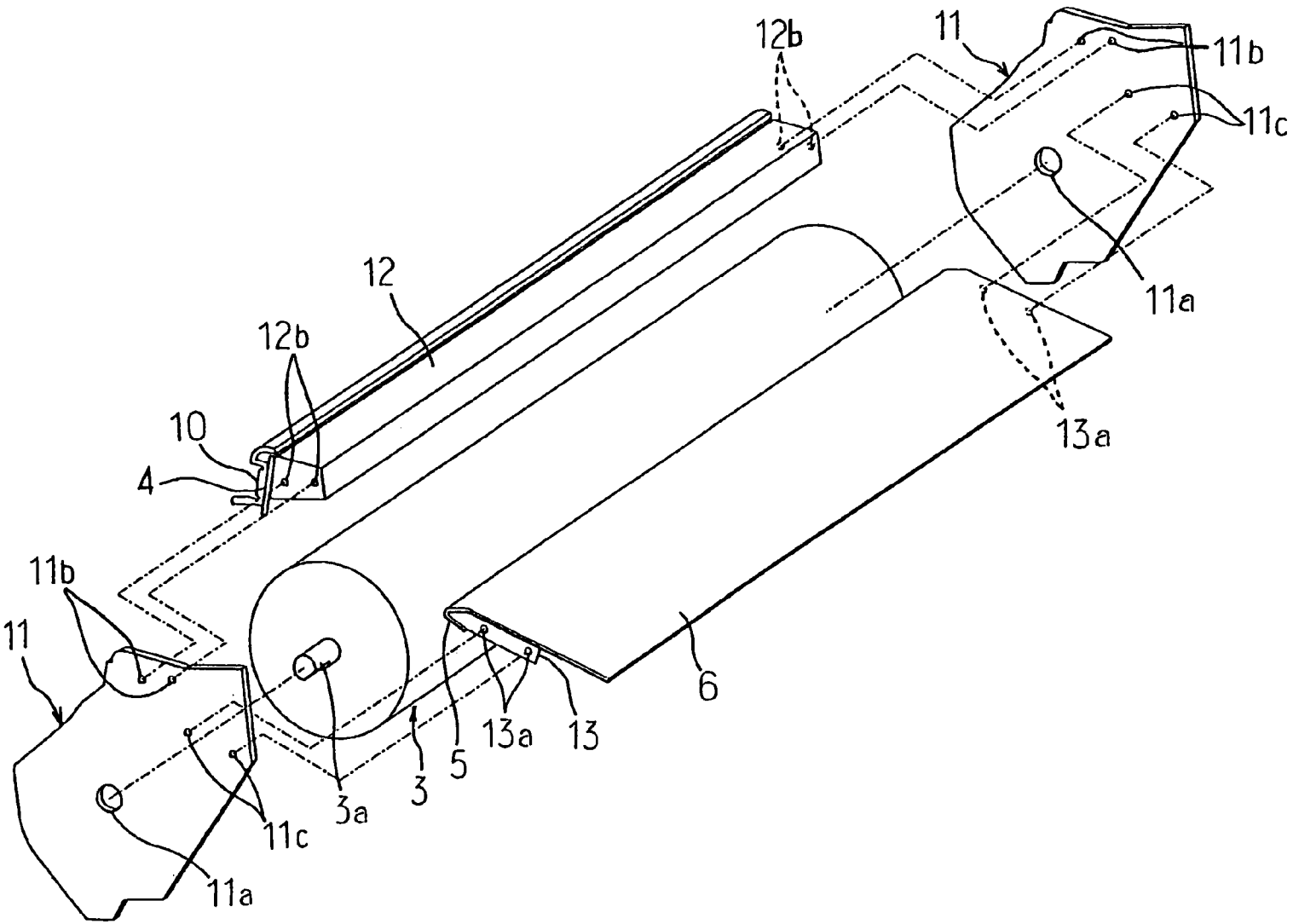
FIG. 3 is an exploded perspective view showing a supporting structure which supports a developing roller and other elements.

FIG. 3 is an exploded perspective view showing a supporting structure for supporting the developing roller and other elements. The development roller 3, the regulating member 4, and the reflux plate 6 (and rubbing member 5) provided in the hopper I as described above are supported by a couple of common supporting members 11, 11. The supporting members 11, 11 are composed of flat plates and include, in their central portions, large-diameter through holes 11*a*, 11*a* to which axis portions 3*a* in both sides of the developing roller 3 are fitted. in addition, the supporting members 11, 11 includes, in their one ends, small-diameter though holes 11*b*, 11*b* which face a plurality of screw holes 12*b*, 12*b* provided in both ends of the first developer accumulation preventing member 12 fixed to the regulating member 4 and smalldiameter through holes 11*c*, 11*c* which face a plurality of screw holes 13*a*, 13*a* provided in both ends of the second developer accumulation preventing member 13 fixed to the rubbing member 5. Then, the axis portions 3*a*in both sides of the developing roller 3 are fitted to the thorough holes 11*a*, 11*a* and external screws such as machine screws are tightened through the screw holes 11*b*, 11*c* to the screw holes 12*b*, 13*a* in a state that the regulating member 4 and the rubbing member 5 are arranged between the supporting members 11, 11. As a result, a unit is formed and the unit is installed in the hopper 1.

In the hopper 1 of the developing device having above described structure, two-component developer is contained. The developer is composed of carrier such as magnetic powder and toner. The developer having small particle size smaller than typical particle size is used. The average particle size of typical carrier is 85 μm, and the average particle size of the carrier used in example embodiment is smaller than or equal to 65 μm. Further, the average particle size of typical toner is 8.5 μm, and the average particle size of the toner used in example embodiment is smaller than or equal to 7.5 μm.

When an electrostatic latent image held by the photosensitive drum 2 is developed, the photosensitive drum 2 rotates in clockwise direction as shown in FIG. 1 and the sleeve 32 of the developing roller 3 and the agitating roller 7 rotate in counterclockwise direction as shown in FIG. 1. The developer in the hopper 1 is transported to the second gap 62 by the developing roller 3 as being agitated by the agitating roller 7 and regulated the transportation amount (layer thickness) in the second gap G2. Then, the developer passes through the second gap G2 as being rubbed by the rubbing member 5. The developer transported to the second gap 62 is regulated in its accumulation by the second developer accumulation preventing member 13 and is transported smoothly to the second gap G2. After passing though the second gap G2, the developer is transported to the first gap G1. The second gap G2 is formed larger than the first gap G1 so that excess developer is certainly generated by the regulating member 4 and a certain developer circulation amount is provided by the rubbing member 5. The excess developer is regulated in its accumulation by the first developer accumulation preventing member 12 and refluxed toward the refiux plate 6, and refluxed toward the upper part of the agitating roller 7 by the reflux plate 6. As a whole, the developer circulates around the reflux plate 6.

The second gap G2 is defined by the rubbing member 5 for rubbing the developer with the developing roller 3 so that it is able to carry out preliminary electrification on the developer when the developer passes through the second gap G2. The regulating member 4 regulates the transportation amount of the preliminarily electrified developer so that the regulating member 4 can perform main electrification on the preliminarily electrified developer. Further, the magnetic pole N2 is arranged so that the polar central axis P2 of the magnetic pole N2 is located in side of the lower transportation stream than the position which is displaced 1.5 degrees toward upper transportation stream with respect to the minimum position (a) of the second gap G2. As a result, as shown in FIGS. 4, 5, 6 and 7 magnetic force toward the polar central axis P2 of the magnetic pole N2 is generated in the second gap G2.

Figure 4:
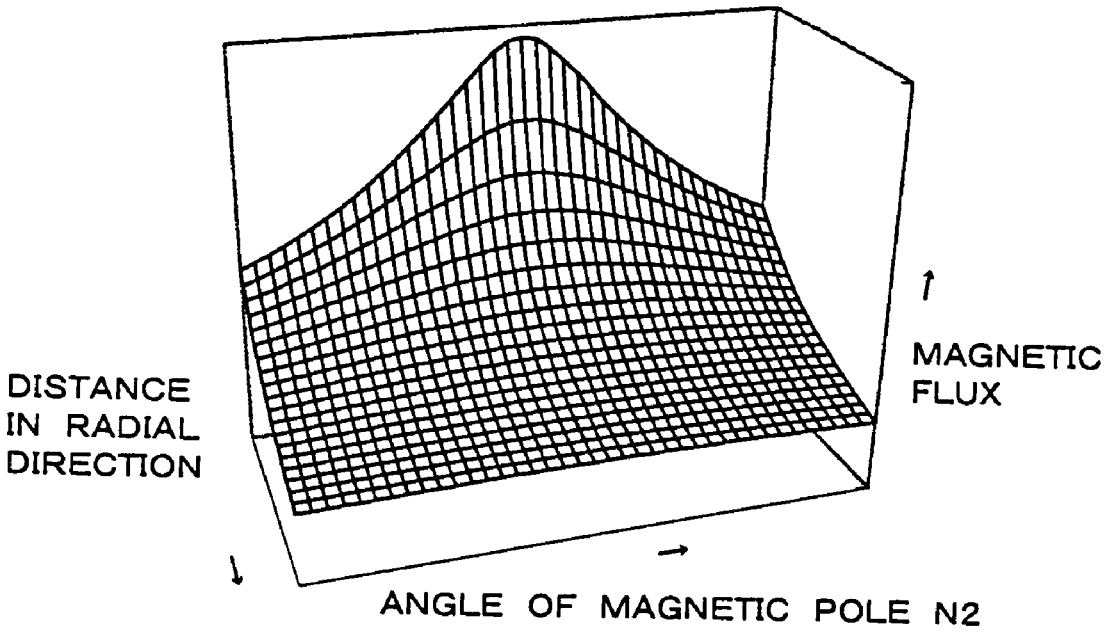
FIG. 4 is a view showing scalar amount of magnetic flux density corresponding to distance in a radial direction on a polar central axis and displacement angle from a minimum position (a) of the polar central axis.
Figure 5:
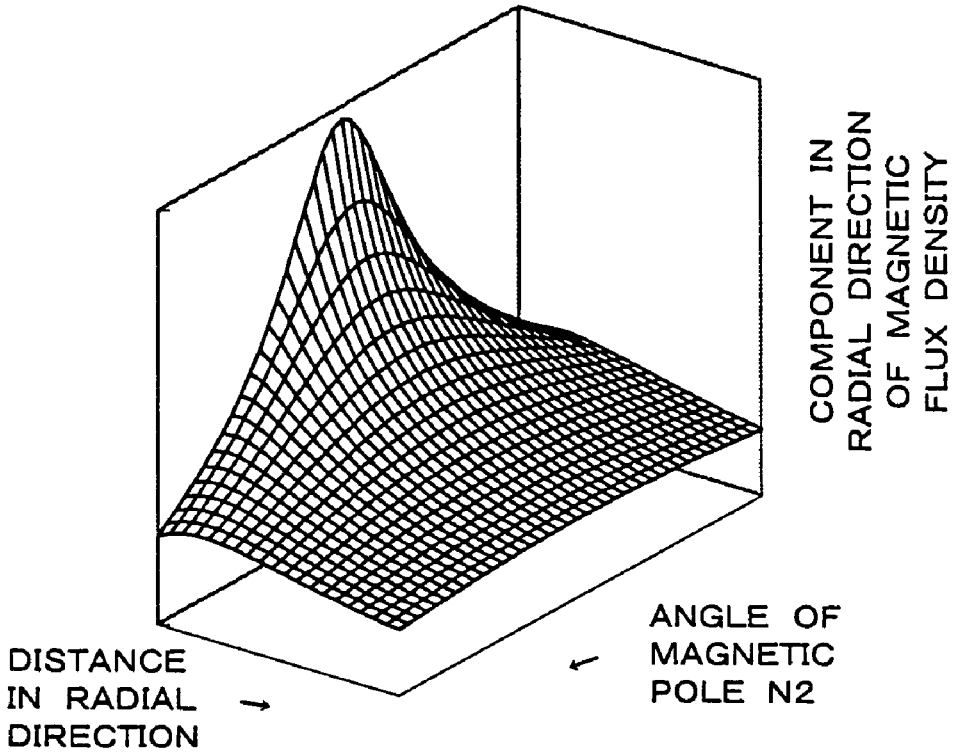
FIG. 5 is a view showing component in the radial direction of magnetic flux density corresponding to distance in the radial direction on a polar central axis and displacement angle from the minimum position (a) of the polar central axis.
Figure 6:
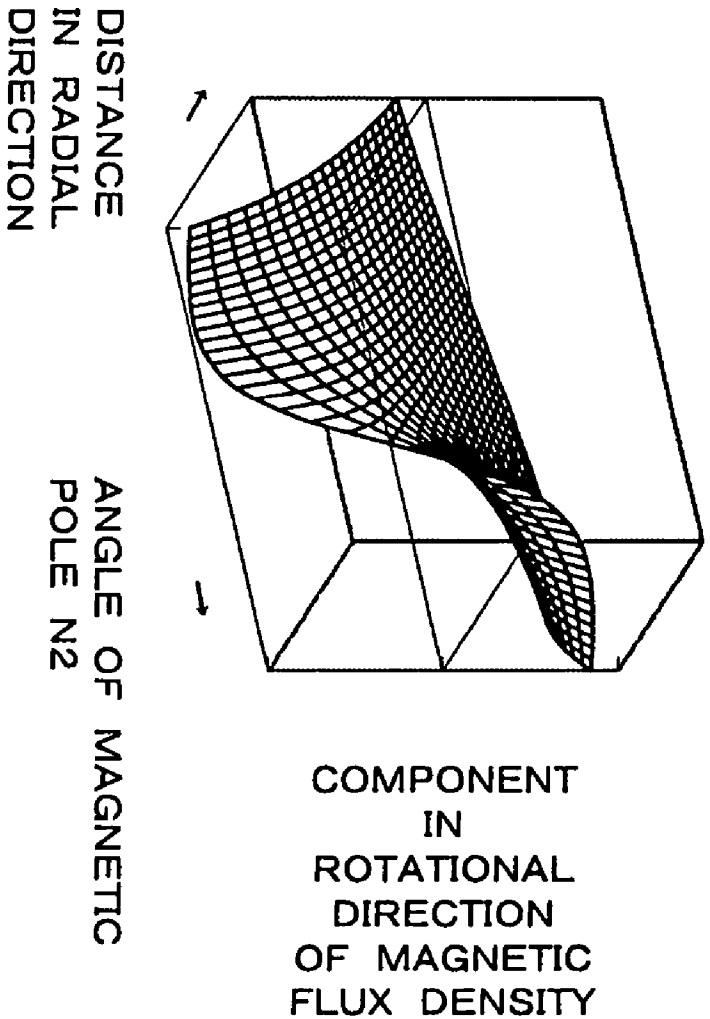
FIG. 6 is a view showing component in a rotational direction of magnetic flux density corresponding to distance in the radial direction on a polar central axis and displacement angle from the minimum position (a) of the polar central axis.

FIG. 4 is a view showing scalar amount of magnetic flux density corresponding to distance in a radial direction on a polar central axis and displacement angle of the polar central axis from a minimum position (a). FIG. 5 is a view showing component in the radial direction of magnetic flux density corresponding to distance in the radial direction on a polar central axis and displacement angle of the polar central axis from a minimum position (a). FIG. 6 is a view showing component in a rotational direction of magnetic flux density corresponding to distance in the radial direction on a polar central axis and displacement angle of the polar central axis from a minimum position (a). It is noted that, in FIGS. 4 to 6, the distance in the radial direction is sum of the radius size of the developing roller 3 and size of the second gap G2.

Figure 7A:
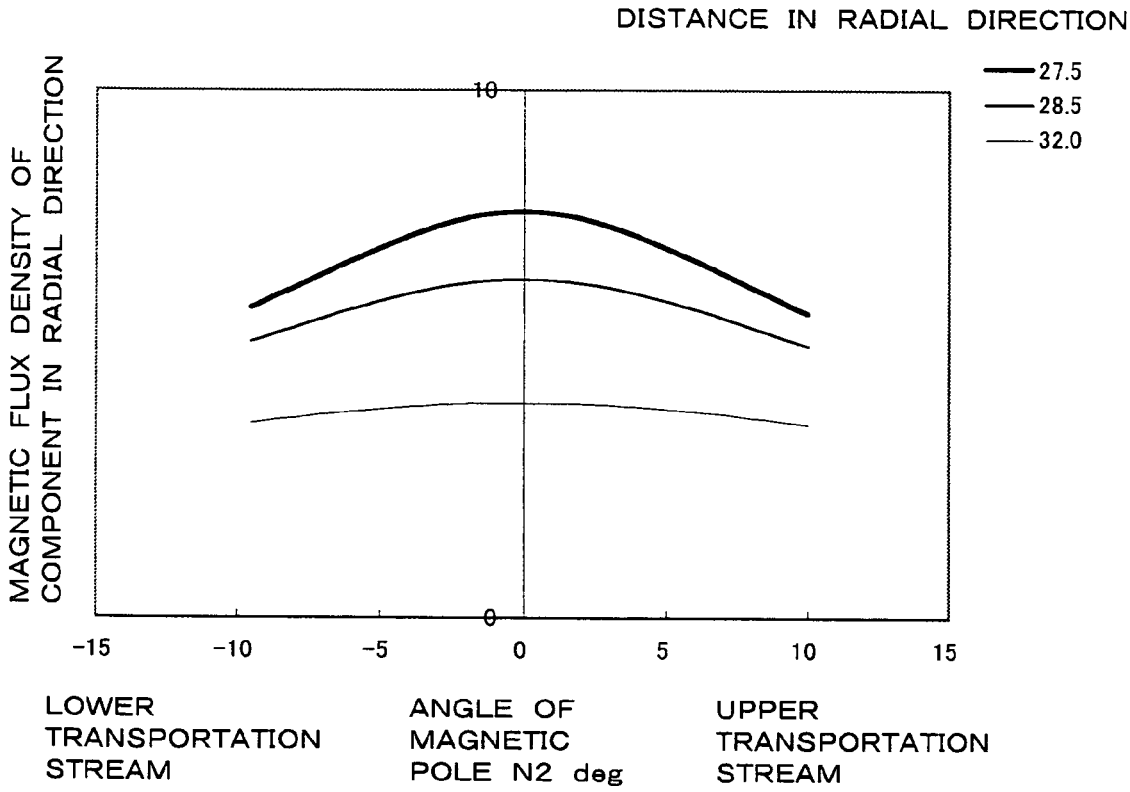
FIG. 7(*a*) is a view showing magnetic flux density of component in the radial direction corresponding to displacement angle from a minimum position (a) of the polar central axis.
Figure 7B:
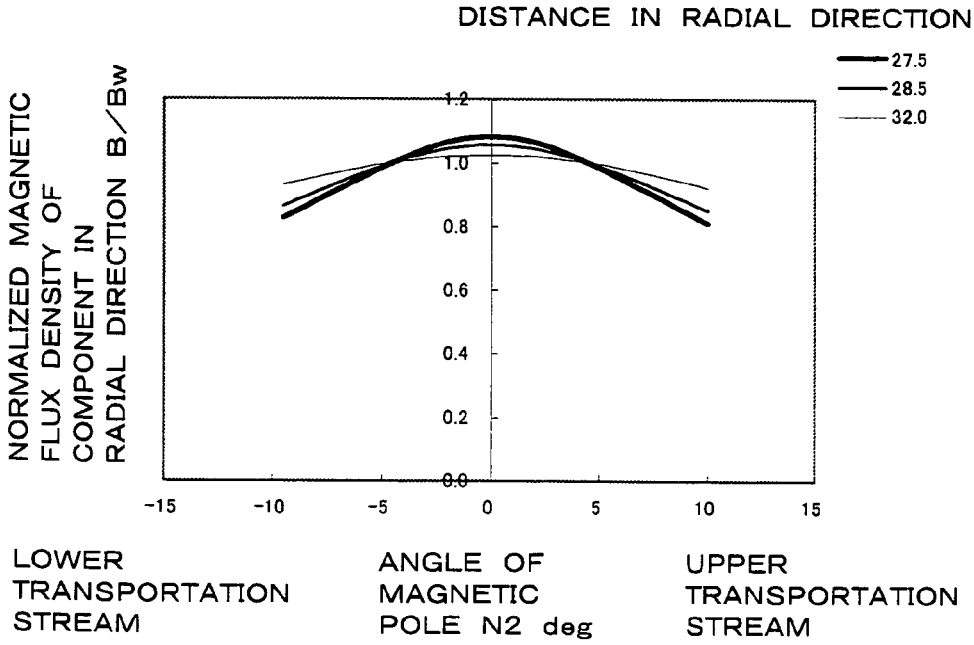

FIG. 7(*a*) is a view showing magnetic flux density of component in the radial direction corresponding to displacement angle of the polar central axis from the minimum position (a). FIG. 7(*b*) is a view showing normalized magnetic flux density of component in the radial direction corresponding to displacement angle of the polar central axis from the minimum position (a). The positive numbers on the horizontal axis indicate displacement angle in the upper transportation stream from the minimum position (a) and the negative numbers on the horizontal axis indicate displacement angle in the lower transportation stream from the minimum position (a). In FIGS. 7(*a*) and 7(*b*), component of the magnetic flux density can be changed by changing the size of the second gap G2 on the polar central axis P2 and the displacement angle of the polar central axis P2 from the minimum position (a). Further, as shown in FIG. 7(*b*), when the width of the magnetic pole N2 Dm=4 mm, it can he made in one {paragraph }by normalizing the component of the magnetic flux density. In FIGS. 7(*a*) and 7(*b*), the radius size of the development roller 3 is set 25 mm. The sizes corresponding to the sum of the radius size of 25 mm and the sizes of the second gap G2, 2.5 mm, 3.5 mm, and 7.0 mm indicate distance in the radial direction of the developing roller 3, 27.5 mm, 28.5 mm, and 32.0 mm.

Figure 8A:
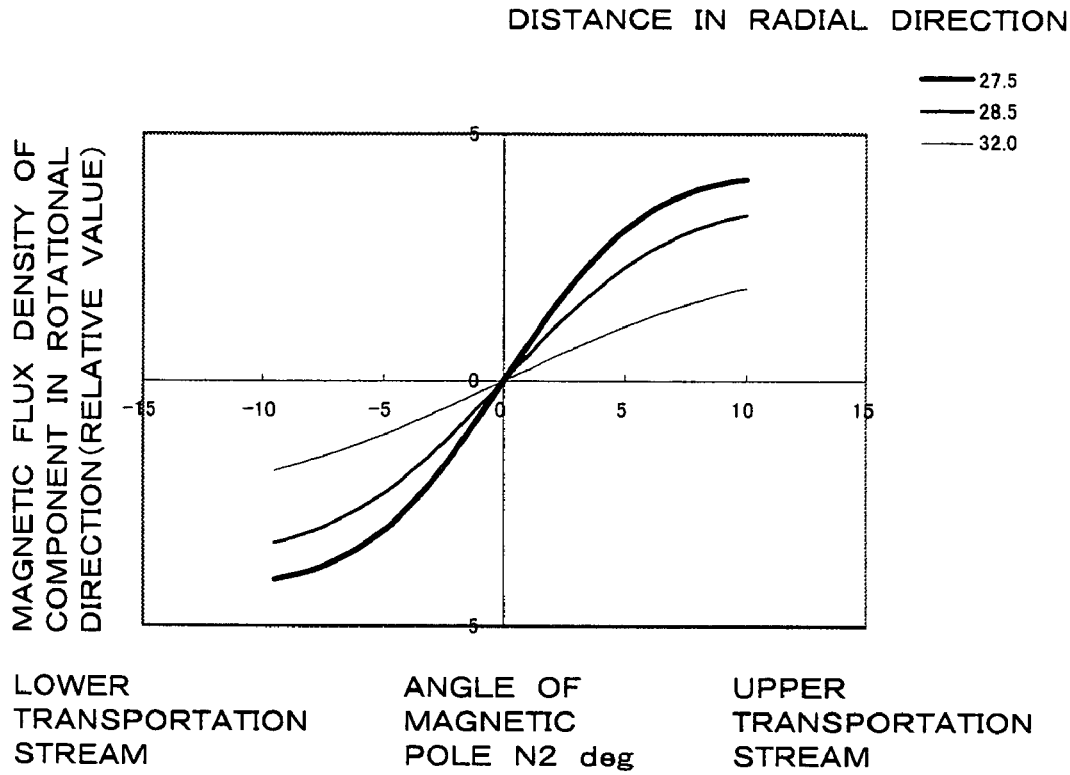
FIG. 8(*a*) is a view showing magnetic flux density of component in the rotational direction corresponding to displacement angle from the minimum position (a) of the polar central axis.
Figure 8B:
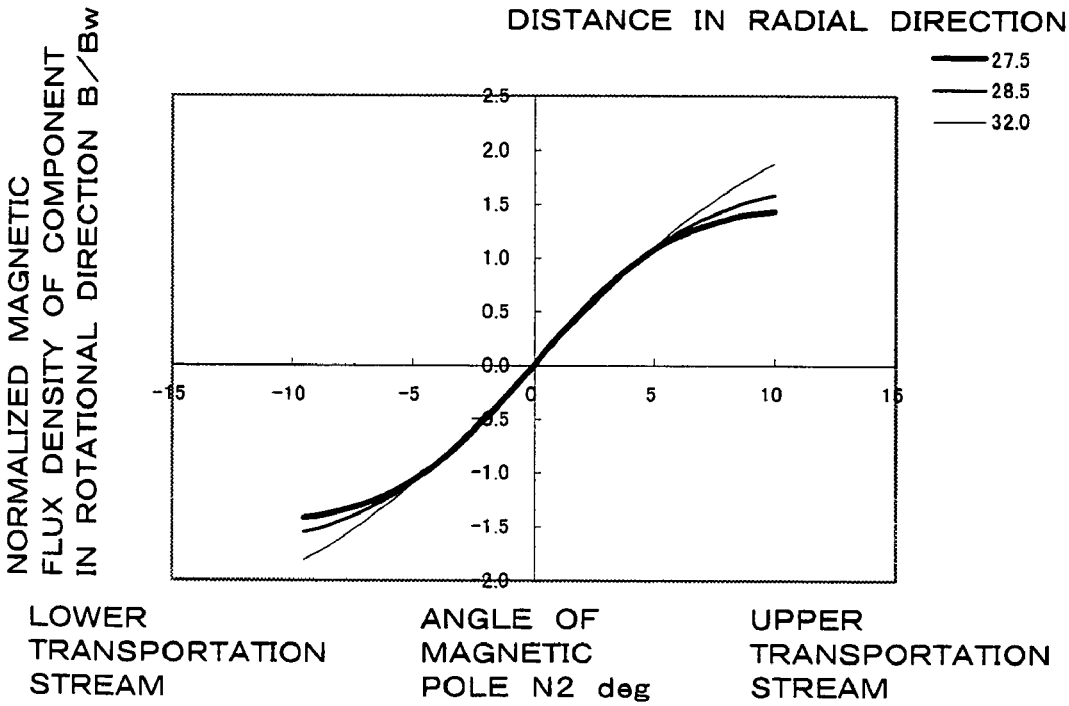

FIG. 8(*a*) is a view showing magnetic flux density of component in the rotational direction corresponding to displacement angle of the polar central axis from the minimum position (a). FIG. 8(*b*) is a view showing normalized magnetic flux density of component in the rotational direction corresponding to displacement angle of the polar central axis from the minimum position (a). The positive numbers on the horizontal axis indicate displacement angle in the upper transportation stream from the minimum position (a) and the negative numbers on the horizontal axis indicate displacement angle in the lower transportation stream from the minimum position (a). The magnetic flux density of the component in rotational direction is normalized as shown in FIG. 8(*a*) so that it can be made in one {paragraph}as shown in FIG. 8(*b*).

Figures 9A, 9B:
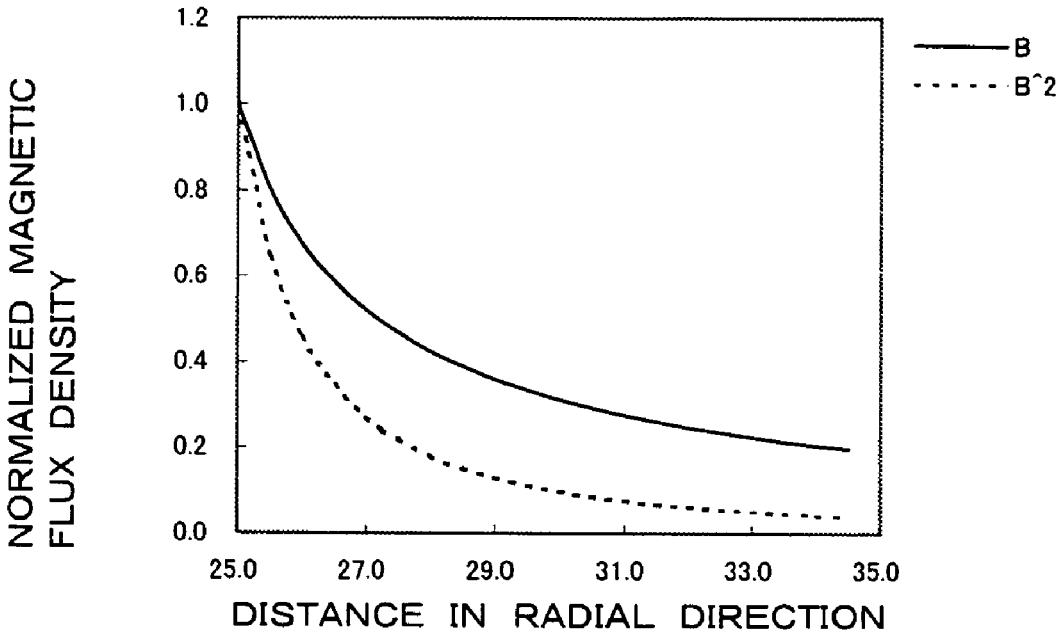
FIGS. 9 are a view and a table showing the relationship between distance in the radial direction and the normalized magnetic flux density on the polar central axis.

FIGS. 9(*a*) and 9(*b*) are views showing the relationship between distance in the radial direction and normalized magnetic flux density on the poiar central axis. The width Dm of the magnetic pole N2 is 4 mm and the second gap G2 is arranged so that G1<G2≦0.8×Dm. As G2≦0.8 ×Dm is set 2.3 mm ×3.2 mm, the magnetic flux density B near the reflux plate 6 becomes high (B≧41%). In other words, magnetic attraction force which is proportional to the square of the magnetic flux density is added to the carrier of the developer ($B^2$≧17%) and the layer thickness is regulated at the end of lower transportation stream at the rubbing member 5 in a condition under relative large frictional force, and hence preliminary electrification can be performed efficiently. Further, preferably, it is set at G2≦(⅔)·Dm, that is, 2.3 mm 2.7 mm, to provide a condition that the magnetic flux density B near the reflux plate 6 is relatively high (B≧45%), that is, a condition that magnetic attraction force which is proportional to the square of the magnetic flux density is added to the carrier ($B^2$≧20%).

Figures 10A, 10B:
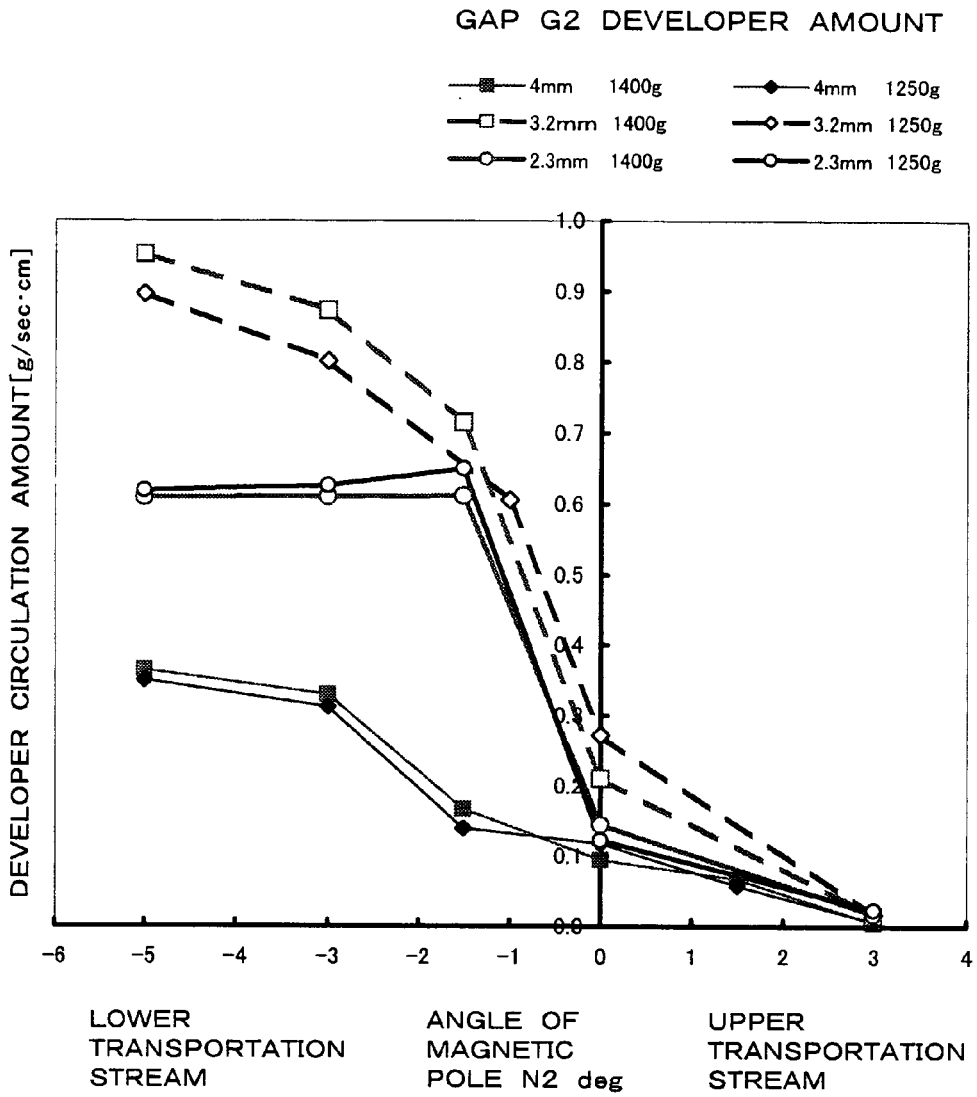
FIG. 10 are a view and a table showing the relationship between the location of the polar central axis with respect to the minimum position (a) of a second gap and developer circulation amount.
Figure 11:
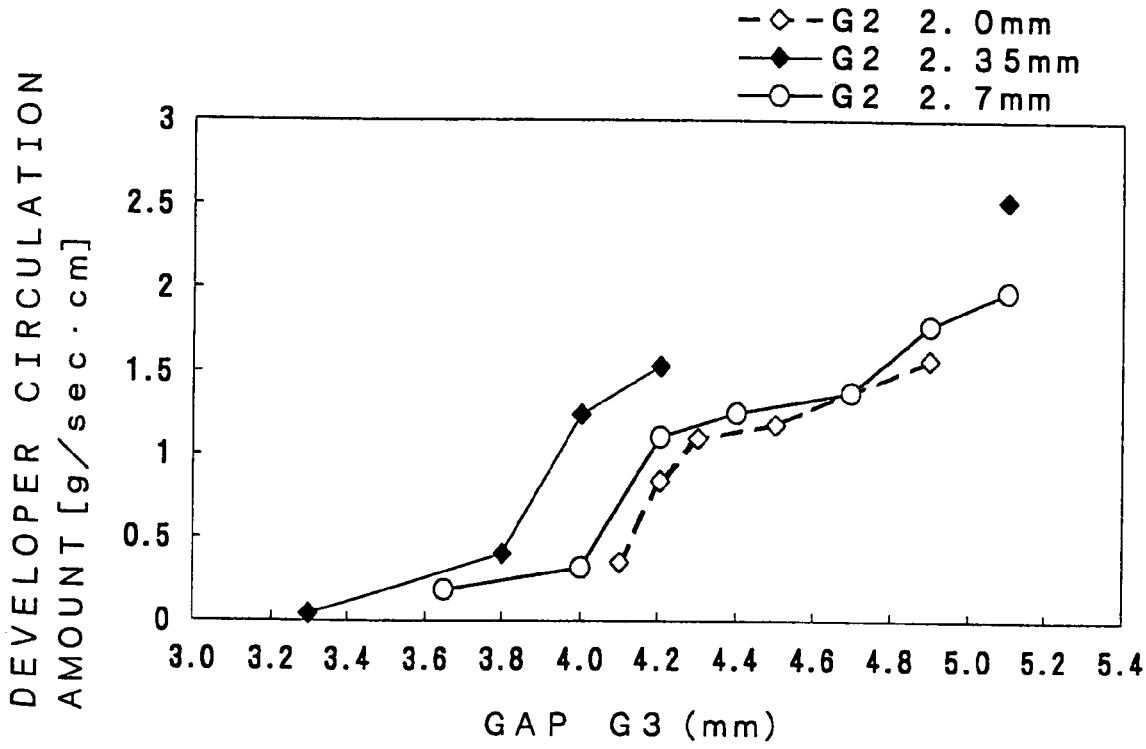
FIG. 11 is a view showing a relationship between a third gap and developer circulation amount.

The first gap G1, the second gap G2, developer amount per unit length M1, and developer amount per unit length M2 are set as M2>(M1/G1)G2. Accordingly, the developer transported to the second gap G2 is not regulated by the rubbing member 5 and the layer thicknesses are uneven. As a result, even when the average value of transportation amount M2av is lower than or equal to the second gap G2 (M1/G1), a part of the developer contacts with the regulating member 4 to be rubbed and circulation amount by the preliminary electrification can be increased. In the condition with the value lower than or equal to the regulation amount, the rubbing condition may be uneven because it heavily depends on the transportation amount and the developer layer forming condition. However, the unevenness can be prevented by the above settings. FIGS. 10(*a*) and 10(*b*) are views showing the relationship between the location of the polar central axis regarding the minimum position (a) of a second gap and developer circulation amount.

As the developer circulation amount is influenced by the developer amount in the hopper 1 and the distance of the second gap, in FIGS. 10(*a*) and 10(*b*) ,the developer circulation amount is measured in a condition that the developer amount in the hopper 1 is 1400 g or 1250 g and the distance of the second gap G2 is 4 mm, 3.2 mm, or 2.3 mm. Until the polar central axis P2 of the magnetic pole N2 moves to the position displaced 1.5 degrees toward the upper transportation stream from the minimum position (a) where the distance of the second gap G2 is minimum, magnetic force is attracted toward the polar central axis P2 in the upper transportation stream with respect to the minimum position (a) and the transportation amount of the developer by the magnetic force in the second gap G2 becomes smaller than the case when displacing toward the lower transportation stream from the minimum position (a). As a result, a stable developer circulation amount can be obtained as shown in FIGS. 10(*a*) and 10(*b*).

The developer circulation amount gradually increases as shown in FIG. 10 by arranging the magnetic pole N2 so that the polar central axis P2 is displaced toward the lower transportation stream from the minimum position (a). However, when the second gap G2 is 2.3 mm, the rubbing member 5 starts to regulate the developer transportation amount in condition that the polar central axis P2 is displaced 1.5 degrees toward the lower transportation stream from the minimum position (a). As a result, the developer circulation amount can be stable even when the polar central axis P2 is displaced more than 1.5 degrees toward the lower transportation stream from the minimum position (a). Further, when the second gap G2 is 4 mm, the rubbing member 5 hardly regulates the transportation amount of the developer so that the development circulation amount cannot be increased as compared to the case in which the second gap G2 is 3.2 mm or 2.3 mm.

Similar to that, as shown in FIGS.(10*a*) and (10*b*), while the rubbing member 5 hardly regulates the developer circulation amount when the second gap G2 is 4 mm, the rubbing member 5 regulates the developer circulation amount when the second gap G2 is 3.2 mm or 2.3 mm, the circulation path resistance in the third gap G3 drastically increases by the rubbing of the first developer accumulation preventing member 12 and the developer, the developer circulation amount drastically reduces when the third gap G3 becomes smaller than 4 mm.

Figure 12:
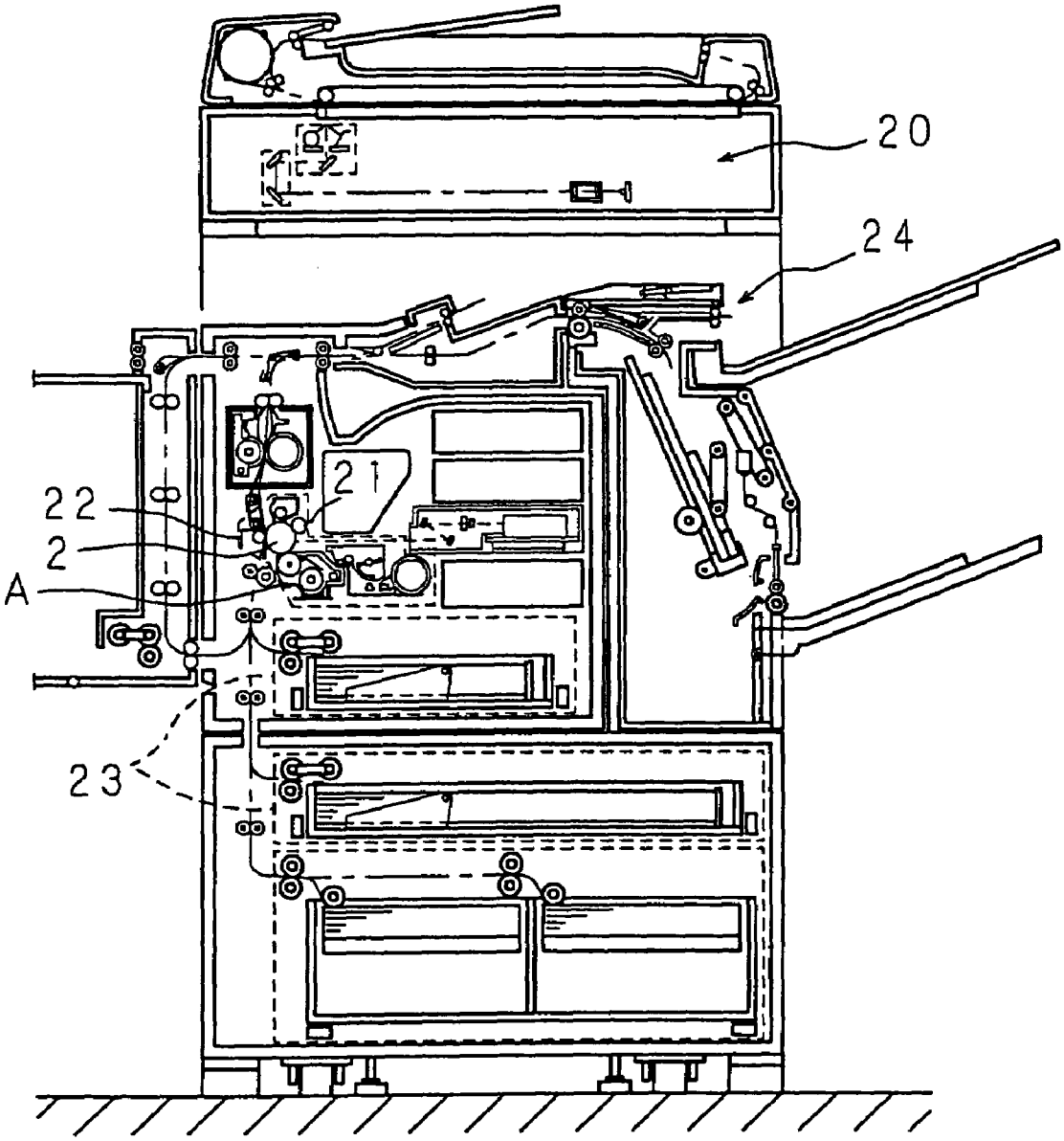
FIG. 12 is a vertical section front view showing a structure of a main part of an image forming apparatus including the developing device according to an example embodiment.
Figure 13:
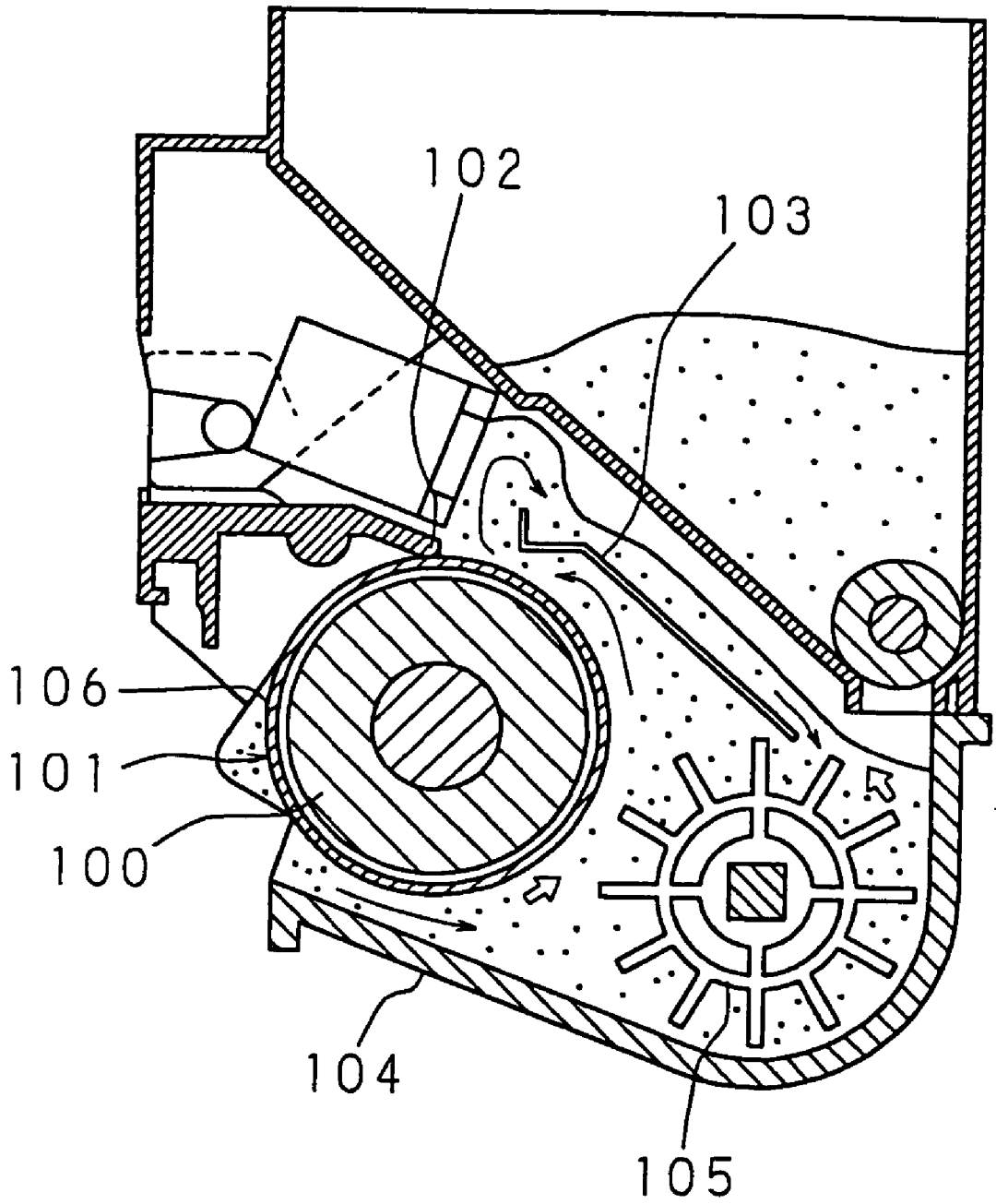
FIG. 13 PRIOR ART
FIG. 13 is a cross-sectional view showing a structure of a conventional developing device.

FIG. 12 is a vertical section front view showing a structure of a main part of an image forming apparatus including the developing device according to example embodiment.

The developing device having the above described structure is installed in, for example, an image forming apparatus having an electrophotographic process unit. The image forming apparatus is, as shown in FIG. 12, a digital copying machine including a scanner 20 for scanning an image of a manuscript, a rotative photosensitive drum 2 (image forming unit) having an electrostatic latent image on its circumference, an electrification means 21 for performing electrification on the photosensitive drum 2, an exposing means having a laser beam scanner for making the photosensitive drum 2 hold the electrostatic latent image corresponding to the image of manuscript, a developing device A for developing the electrostatic latent image, a transferring means 22 for transferring the developed toner image on the photosensitive drum 2 on a sheet, a cleaning means for removing developer remained in the photosensitive drum 2, an electricity removing means for removing electrification of the photosensitive drum 2, a sheet feeding unit 23 for feeding a sheet toward the photosensitive drum 2, and a sheet post-treatment unit 24 for post-treating the sheet on which an image is formed.

According to the above described embodiment, a rubbing member is configured with a reflux plate in one plate shape, however, the rubbing member may be provided separately from the reflux plate.

The invention claimed is:

1. A developing device comprising:

a developing roller having a magnet roller configured to transport developer to be used in developing an electrostatic latent image;

a regulating member configured to regulate an amount of the developer transported to the electrostatic latent image with the development roller;

a reflux plate configured to reflux excess developer regulated by the regulating member away from the regulating member; and a rubbing member arranged to face the developing roller at a second gap which is larger than a first gap defined by the developing roller and the regulating member, wherein the rubbing member is configured to rub developer transported to the first gap in order to create friction prior to preliminary electrification of the developer; and wherein the magnet roller has a plurality of magnetic poles arranged in circumferential direction thereof and one of the magnetic poles is provided so that a polar central axis thereof faces the second gap and the polar central axis is positioned between the regulating member and a position upstream of a direction of developer transportation that is 1.5 degrees from a minimum position of the second gap; and wherein the second gap G2 (mm) $G1<G2\leqq 0.8\times Dm$, where G1 is the first gap (mm) and Dm is a width of magnetic pole (mm).

2. The developing device according to claim 1, wherein the magnetic pole is arranged so that the polar central axis is positioned between the regulating member and the minimum position of the second gap.

3. The developing device according to claim 1, further comprising a developer accumulation preventing member positioned near the regulating member and/or the rubbing member configured to prevent accumulation of developer transported.

4. The developing device according to claim 3, wherein the reflux plate and the developer accumulation preventing member provided near the regulating member define a third gap.

5. The developing device according to claim 4, wherein the third gap is larger than the second gap.

6. The developing device according to claim 1, wherein the rubbing member is integrally formed with the reflux plate.

7. The developing device according to claim 6, wherein the developer accumulation preventing member provided near the regulating member has a convex portion which contacts with the reflux plate and is configured to prevent the displacement of the rubbing member by developer.

8. The developing device according to claim 1, wherein the regulating member and the rubbing member have similar coefficients of linear expansion.

9. The developing device according to claim 1, wherein the developing roller, the regulating member, and the rubbing member are supported by a common supporting member.

10. The developing device according to claim 1, wherein amount of developer transported to the second gap M2 (g/s/cm) is defined as $$M2>(M1/G1)G2$$

where G1 is the first gap (mm), G2 is the second gap (mm), and M1 is the amount of developer transported from the first gap (g/s/cm).

11. The developing device according to claim 1, further comprising a hopper containing developer including magnetic powder having an average particle size is smaller than or equal to 65 μm and toner having an average particle size smaller than or equal to 7.5 μm.

12. A developing device, comprising:

a developing roller having a magnet roller configured to transport developer to be used in developing an electrostatic latent image;

a regulating member configured to regulate an amount of the developer transported to the electrostatic latent image with the development roller;

a reflux plate configured to reflux excess developer regulated by the regulating member away from the regulating member; and a rubbing member arranged to face the developing roller at a second gap which is larger than a first gap defined by the developing roller and the regulating member, wherein the rubbing member is configured to rub developer transported to the first gap, in order to create friction prior to preliminary electrification of the developer; and wherein the magnet roller has a plurality of magnetic poles arranged in circumferential direction thereof and one of the magnetic poles is provided so that the magnetic pole faces the second gaps and a polar central axis thereof corresponds to a minimum position of the second gap; and wherein the second gap G2 (mm) $G1<G2\leqq 0.8\times Dm$, where G1 is the first gap (mm) and Dm is a width of magnetic pole (mm).

13. The developing device according to claim 12, further comprising a developer accumulation preventing member configured to prevent accumulation of developer transported to the gap near the regulating member and/or the rubbing member.

14. The developing device according to claim 13, wherein the reflux plate and the developer accumulation preventing member provided near the regulating member define a third gap.

15. The developing device according to claim 14, wherein the third gap is larger than the second gap.

16. The developing device according to claim 12, wherein the rubbing member is integrally formed with the reflux plate.

17. The developing device according to claim 16, wherein the developer accumulation preventing member provided near the regulating member has a convex portion which contacts with the reflux plate and is configured to prevent the displacement of the rubbing member by developer.

18. The developing device according to claim 12, wherein the regulating member and the rubbing member have similar coefficients of linear expansion.

19. The developing device according to claim 12, wherein the developing roller, the regulating member, and the rubbing member are supported by a common supporting member.

20. The developing device according to claim 12, wherein amount of developer transported to the second gap M2 (g/s/cm) is defined as $$M2>(M1/G1)G2$$

where G1 is the first gap (mm), G2 is the second gap (mm), and M1 is the amount of developer transported from the first gap (g/s/em).

21. The developing device according to claim 12, further comprising a hopper containing developer including magnetic powder having average particle size smaller than or equal to 65 μm and toner having an average particle size smaller than or equal to 7.5 m.

22. A developing device, comprising:

a developing roller having a magnet roller configured to transport developer to be used in developing an electrostatic latent image;

a regulating member configured to regulate an amount of the developer transported to the electrostatic latent image with the development roller;

a reflux plate configured to reflux excess developer regulated by the regulating member away from the regulating member; and a rubbing member arranged to face the developing roller at a second gap which is larger than a first gap defined by the developing roller and the regulating member, wherein the rubbing member is configured to rub developer transported to the first gap in order to create friction prior to preliminary electrification of the developer; and wherein the magnet roller has a plurality of magnetic poles arranged in circumferential direction thereof and one of the magnetic poles is provided so that the magnetic pole faces the second gap and a polar central axis thereof is located between a position corresponding to the minimum position of the second gap and a position displaced 1.5 degree upstream from the minimum position of the second gap in a direction of developer developer transportation; and wherein the second gap G2 (mm) is defined as $G1<G2\leqq 0.8\times Dm$, where G1 is the first gap (mm) and Dm is a width of magnetic pole (mm).

23. The developing device according to claim 22, further comprising a developer accumulation preventing member configured to prevent accumulation of developer transported to the gap near the regulating member and/or the rubbing member.

24. The developing device according to claim 23, wherein the reflux plate and the developer accumulation preventing member provided near the regulating member define a third gap.

25. The developing device according to claim 24, wherein the third gap is larger than the second gap.

26. The developing device according to claim 22, wherein the rubbing member is integrally formed with the reflux plate.

27. The developing device according to claim 26, wherein the developer accumulation preventing member provided near the regulating member has a convex portion which contacts with the reflux plate and is configured to prevent the displacement of the rubbing member by developer.

28. The developing device according to claim 22, wherein the regulating member and the rubbing member have similar coefficients of linear expansion.

29. The developing device according to claim 22, wherein the developing roller, the regulating member, and the rubbing member are supported by a common supporting member.

30. The developing device according to claim 22, wherein amount of developer transported to the second gap M2 (g/s/cm) is defined as $$M2>(M1/G1)G2$$

where G1 is the first gap (mm), G2 is the second gap (mm), and M1 the amount of developer transported from the first gap (g/s/cm).

31. The developing device according to claim 22, further comprising a hopper containing developer including magnetic powder having an average particle size smaller than or equal to 65 μm and toner having an average particle size smaller than or equal to 7.5 μm.

32. An image forming apparatus, comprising:

a developing device of claim 1 developing an electrostatic latent image; and an image forming unit configured to form a developed image on a sheet.

33. An image forming apparatus, comprising: a developing device of claim 12 developing an electrostatic latent image; and an image forming unit configured to form a developed image on a sheet.

34. An image forming apparatus, comprising:

a developing device of claim 22 developing an electrostatic latent image; and an image forming unit configured to form a developed image on a sheet.

35. The image forming apparatus of claim 4, wherein the third gap is equal to or larger than 4.2 mm.

36. The image forming apparatus of claim 14, wherein the third gap is equal to or larger than 4.2 mm.

37. The image forming apparatus of claim 24, wherein the third gap is equal to or larger than 4.2 mm.

* * * * *